United States Patent [19]

Rijnders

[11] Patent Number: 4,706,433

[45] Date of Patent: Nov. 17, 1987

[54] SUSPENDED CEILING ASSEMBLY

[75] Inventor: Willem Rijnders, Papendrecht, Netherlands

[73] Assignee: Hunter Douglas International N.V., Curacao, Netherlands Antilles

[21] Appl. No.: 785,316

[22] Filed: Oct. 7, 1985

[30] Foreign Application Priority Data

Dec. 6, 1984 [GB] United Kingdom ..... 8430813

[51] Int. Cl.[4] ..... E06B 9/26

[52] U.S. Cl. ..... 52/473; 52/507; 160/166 A

[58] Field of Search ..... 160/126, 123, 345, 166 A, 160/168, 166; 52/484, 64, 63, 507, 473

[56] References Cited

U.S. PATENT DOCUMENTS

| | | | |
|---|---|---|---|
| 1,858,801 | 5/1932 | Bolard | 160/166 A |
| 2,158,454 | 5/1939 | Zabiria | 160/166 A |
| 2,607,409 | 8/1952 | Svirsky | 160/166 A |
| 2,625,219 | 1/1953 | Peck | 160/166 A |
| 2,635,686 | 4/1953 | King | 160/166 A |
| 2,754,902 | 7/1956 | Attkisson | 160/166 A |
| 2,794,498 | 6/1957 | Heckerman | 160/166 A |
| 3,295,284 | 1/1967 | Tschiesche | 52/507 |
| 3,911,638 | 10/1975 | Englund | 52/484 |
| 4,114,673 | 9/1978 | de Wit | 160/166 A |

FOREIGN PATENT DOCUMENTS

| | | | |
|---|---|---|---|
| 3245214 | 6/1984 | Fed. Rep. of Germany | 52/484 |
| 296587 | 5/1954 | Switzerland | 52/78 |
| 2074208 | 10/1981 | United Kingdom | 52/484 |

*Primary Examiner*—Henry E. Raduazo

*Attorney, Agent, or Firm*—Pennie & Edmonds

[57] ABSTRACT

Suspended ceiling assembly includes a plurality of supporting members 14 which carry panels of the ceiling, the members 14 being longitudinally slidable along a beam having a web 11 and side flanges 12 terminating in rims 13. The mutual spacing between the supporting members 14 is determined by distance members (not shown) and the supporting members 14 are arranged in groups, the end ones of the groups being held in place by clips 37 having a projection 40 engaged in an aperture 41 in the web of the channel to hold the members of the group in position. When the clips are removed, the panels can be pulled back, to gain access to the space thereabove.

8 Claims, 7 Drawing Figures

Fig. 1.
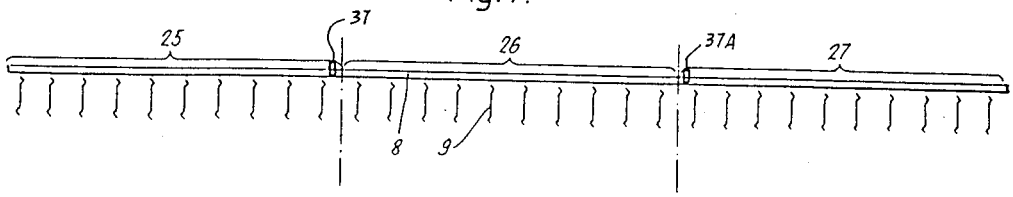
Fig. 2.
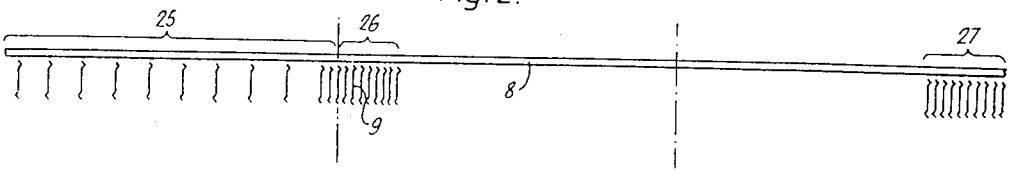
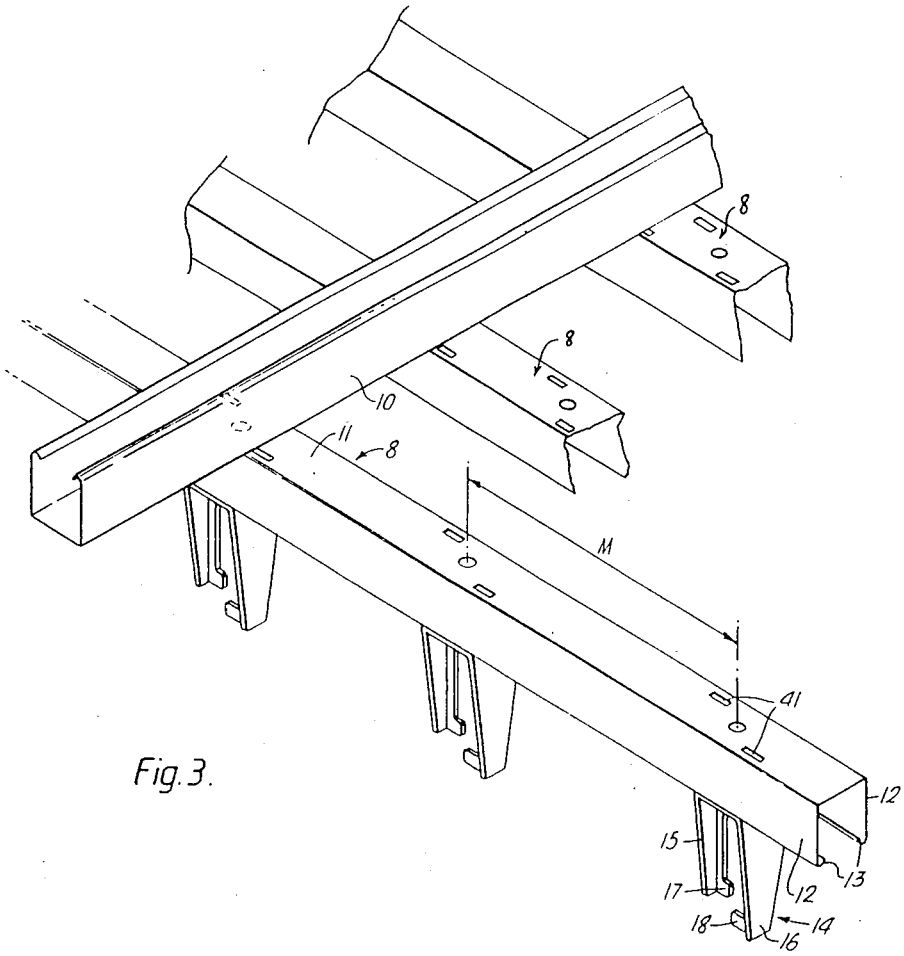
Fig. 3.

SUSPENDED CEILING ASSEMBLY

The present invention relates to suspended ceiling assemblies.

Various types of suspended ceilings have been proposed, one particular type involves a number of generally parallelly arranged support beams upon which are mounted, usually at right angles to the support beams, a large number of panels which can be spaced apart from one another. In one type of such suspended ceiling the panels extend generally vertically downwardly, but there are many other types in which the panels are at an angle to the vertical or indeed are horizontal.

It is sometimes necessary to remove the panels to enable one to do maintenance work, for example, on electrical or other installations above the ceiling and it has been proposed, for example, in the constructions illustrated in Netherlands Patent Application Nos. 7 213 187; 7 404 321 and 7 426 096, to provide for the panels to be moved longitudinally of the support beams. However, none of these systems an entirely satisfactory solution. The arrangement of 7 404 321 utilizes a supporting member for each panel in each beam, the supporting member having a tongue which engages in an appropriate aperture in the beam. In order to move the beam one has to disengage each tongue and maintain it disengaged relative to the several apertures in order to sweep several panels to an out-of-the-way position. 7 213 187 utilizes rigid spacer bars between adjacent supporting members and these each have to be removed to enable the supporting members to be brought together which is a cumbersome operation. 7 426 096 utilizes a sprung-loaded ball engageable in a detent in the beam and this does not provide a really satisfactory positive positioning of the panel and the supporting members can readily become dislodged or misaligned.

It is now proposed, according to the present invention, for the supporting members and the elongate panels supported thereby to be arranged in at least one group, and for the positioning means to comprise distance members, which interconnect supporting members or panels of the group supported thereby, in a manner to allow a preselected maximum mutual spacing between the panels of the group and unhindered closing of the mutual spacings upon displacement of said panels and supporting members along said two support beams, in a direction to remove the panels from a certain ceiling area at least one supporting member of a first end panel of the group, cooperating with a locking means releasably to lock the position of said first end panel supporting member with respect to its beam, and a supporting member of the other end panel of the group cooperating with a fixing means for holding the other end panel supporting member in a predetermined position with respect to its beam.

With such a construction, when the locking means is removed, the panels and their supporting members are free to move towards one another, and can simply be caused to "concertina" together. When it is desired to replace the panels one simply pulls the first end panel back to its original position, which is determined by the distance members, and inserts the ocking means to hold the thus formed assemby of that group of panels and their supporting members in place.

It is possible to provide at least one additional support beam parallel to said two support beams, with additional supporting members for supporting the panels of the group and for displacement therewith. Similarly, it is possible to provide several groups of panels supported by said two support beams or larger number of support beams if the additional beams are provided.

The general plane of each panel of the assembly is preferably at an angle to the plane including the longitudinal axes for the beams and thus, for example, the general plane of each panel may be vertical. It is also contemplated that the arrangement of the invention could also be employed with generally horizontal panels but the scope for moving the the panels towards one another would then be significantly reduced.

In a preferred construction the fixing means are similar to or identical with the locking member or members. The support beams may each comprise, at least at or adjacent to the positions to be occupied by the relevant supporting member of the end panels of a group, when the panels are at their maximum mutual spacing, locating means, such as ribs, recesses or apertures, and the fixing means and/or the locking means, said clip having a surface engageable by the relevant supporting member of the end panel of the group to maintain said supporting member in said position.

The beams will normally be of channel shaped cross-section with their webs uppermost and said locating means comprise apertures formed in the webs, the clips including a body portion extending beside the outside of one flange of the channel and an upper arm extends over a portion of the web, with the projection on the upper arm engaging in the aperture to locate the clip in place, and a lower arm extends under the flange, the side of the arm being engageable by a supporting member to hold the supporting member in position.

The free edges of the flanges of the beams preferably have inwardly extending rims along which portions of the supporting members can slide. The lower arm of each clip can then have an upturned tab which is lockably engageable against the inner surface of the rim to retain the clip in place and each clip can include a tongue which can be manually grasped to disengage the tab from the rim to enable the clip to be removed.

The distancing members can take many different forms. For example they can be formed by rods, strips or the like, each distance member being carried by a supporting member and slidably and engageably cooperating with the adjacent supporting member, said distance members being interchangeable to give a different preselected spacing between adjacent panels. Similarly, they could be in the form of wires which can, for example, have a loop passed over a post on the supporting member and having a locking looped tail which is engaged by the upturned tip of an adjacent wire distance member. Alternatively, they can be in the form of cords or of bead chains.

In order that the invention may more readily be understood, the following description is given, merely by way of example, reference being made to the accompanying drawings, in which:

FIG. 1 is a schematic side elevation of one embodiment of suspended ceiling according to the invention;

FIG. 2 is a view similar to FIG. 1 with two groups of panels and their supporting members pulled back;

FIG. 3 is an enlarged perspective view of a portion of the assembly of FIG. 1;

Figure 4:
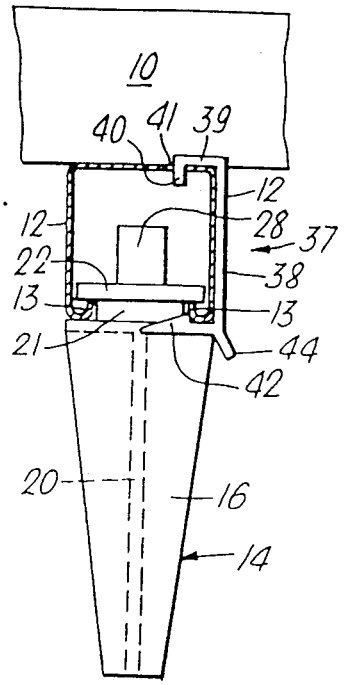
FIG. 4 is an end view of a beam showing the supporting member and locking clip.

Referring first to FIG. 1, there is illustrated a beam 8, which is one of several such beams extending parallel to one another, the beams 8 having located therebelow several parallel generally vertically extending elongate panels 9, with the length of the panels 9 being at an angle, e.g. 90°, to the length of the beams 8.

FIG. 3 illustrates more clearly the beams 8 as being carried by stringers 10, the beams 8 being of inverted channel section having a web 11, side flanges 12, the free ends of which are formed with inturned rims 13.

A supporting member 14 comprises two downwardly extending parallel spaced apart limbs 15, 16, the limb 15 having an inwardly extending lug 17 while the limb 16 has lower and upper lugs 18 and 19, the lugs 17, 18, 19 each being formed in an inwardly projecting fin 20.

The supporting member comprises a neck 21 which can pass between the rims 13 of the channel and a head 22 which can be snap-fitted behind the rims 13.

The supporting members 14 and their panels 9 are arranged, as can be seen in FIGS. 1 and 2, in several groups indicated by the reference numeral 25, 26 and 27 although, of course, more than three groups will usually be provided. In FIG. 1 the groups are arranged in their normal position, that is with the panels 9 all equally spaced.

In FIG. 2 the groups 26 and 27 are shown moved outwardly from one another so that the panels 9 are all in substantially abutting relation, thereby to leave a significant gap therebetween to enable one to carry out maintenance work above the ceiling.

Figure 6:
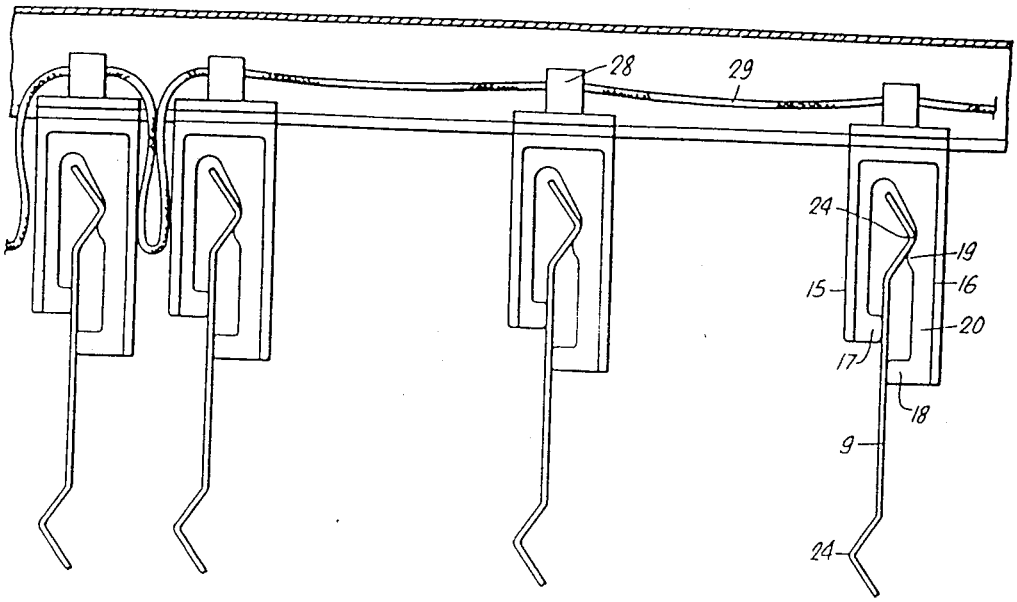
FIG. 6 is a schematic side elevation of a number of panels shown being moved towards one another.
Figure 7:
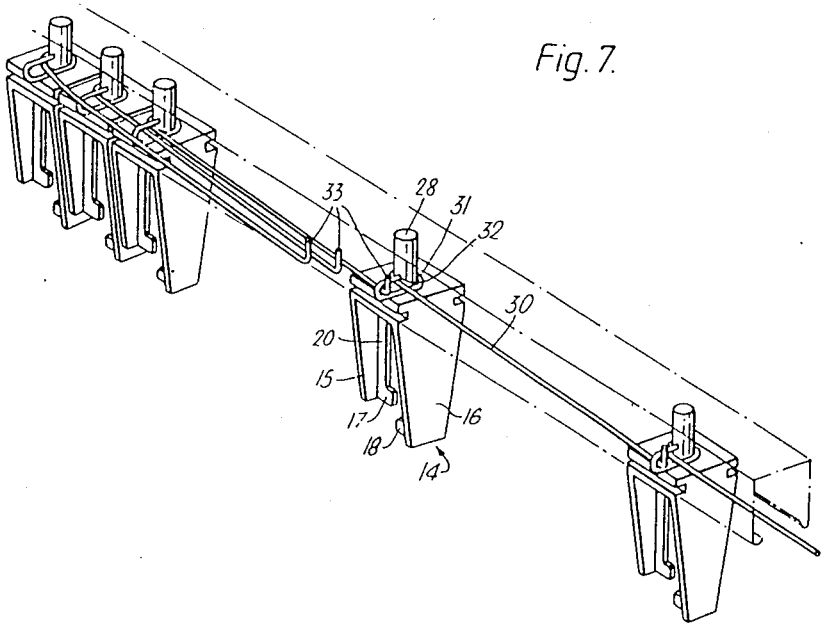
FIG. 7 is a perspective view illustrating several supporting members and an alternative form of distance member.

This can be achieved with the construction of the present invention very readily. The actual spacing, as shown in FIG. 1, between adjacent panels is determined by distancing pieces which, for example, as shown in FIG. 6, are in the form of cords or bead chains 29 engaged on posts 28 extending upwardly from the supporting members. An alternative arrangement is illustrated in FIG. 7 in which wires 30 are provided with a loop 31 passing over the post 28, the loop terminating ina tail 32 through which passes the end of an adjacent wire 30, an upturned 33 of which can engage the tail to determine the spacing between adjacent supporting members 14.

Figure 5:
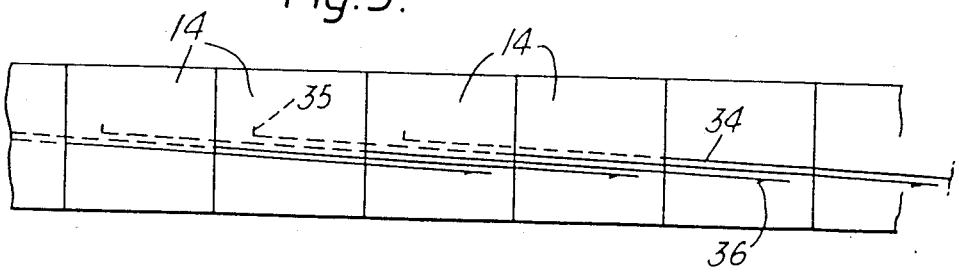
FIG. 5 is a schematic top plan illustrating several supporting members located adjacent one another.

FIG. 5 illustrates a preferred construction in which the spacing members comprise a metal or plastic strip 34 having bent ends 35 and punched out tangs 36 adjacent the end. These tangs engage on a bridge (not shown) on the adjacent supporting member 14 to maintain the correct spacing therebetween.

For each group 25, 26, 27 there are provided at least two clips 39 37A which form both a locking member 37 and a fixing means 37A. The clips 37 37A include a body 38 which extends adjacent to the flange 12 of the beam 8, an upper arm 39 extends over the rim 11, the free end of the upper arm having a downwardly extending projection 40 which can engage in an aperture 41 which is appropriately positioned on the beam. A lower arm 42 of the clip is provided with an upturned tab 43 which can engage against a rim 13 to hold the clip in place and this can be released by a tongue 44 being grasped and pulled away to the right, as shown in FIG. 4. The clip 37 37A can be positioned against an end supporting member 14 of a group 25, 26 or 27, to act as a fixing means, the remaining supporting members then being pulled away from one another so that their mutual spacing is determined by the distance members in the form of the cord 29, wire 30 or strip 34 and then a further clip is placed in the appropriate aperture 41 adjacent the other end supporting member of the group, to act as a locking means to hold all of the supporting members in their desired position.

When one wishes to pull the panels back to obtain access to the space thereabove, one simply undoes one of these clips 37, 37A and moves the supporting members adjacent one another as shown in FIG. 2. In some circumstances, it may be necessary to remove, so that several clips 37, 37A several groups of panels and their supporting members can be pulled back. Reassembly is then equally easy.

I claim:

1. A suspended ceiling assembly comprising, a number of elongate panels, two parallelly arranged fixed support beams (8) having a longitudinally axis, panel supporting members (14) supported by said beams and displaceable therealong, said panel supporting members having panel holding means (15 and 20) cooperating with the panels (9) to hold the panels with their longitudinal axes at an angle to the longitudinal axes of the beams, the supporting members (14), which are supported by at least one of the beams, having positioning means for positioning and holding the supporting members at preselected mutual distances along the beam length, the positioning means being capable of being deactivated to allow displacement of the supporting members, with the panels carried thereby, along the beams, to remove the panels from a certain ceiling area, characterised in that the supporting members (14) and said elongate panels (9) supported thereby are arranged in a group (25, 26, 27) and in that the positioning means comprise distance members (29, 30, 34) which interconnect the supporting members or the panels of the group supported thereby in a manner to allow a preselected maximum mutual spacing between the panels of the group and unhindered closing of the mutual spacings upon displacement of said panels and their supporting members along said two support beams, in a direction to remove panels from said certain ceiling area, at least one supporting member of a first end panel of the group, cooperating with a locating means on its beam and a locking means to releasably lock the position of said first end panel supporting member with respect to its beam and at least one further supporting member of the other end panel of the group, cooperating with a locating means on its beam and a fixing means for holding the other end panel supporting member in a predetermined position with respect to its beam, said locking means and fixing means each comprising a separate clip engageable with said locating means, said clip having a surface engageable by the supporting member to maintain said supporting member in said predetermined position.

2. A suspended ceiling assembly according to claim 1, characterised in that it comprises at least one additional support beam, parallel to said two support means with additional supporting members for supporting the panels of the group and for displacement therewith.

3. A suspended ceiling assembly according to claim 1, 2, characterised in that each panel (9) of the assembly has a general plane which is at an angle to the plane including the longitudinal axes of the beams (8).

4. A suspended ceiling according to any preceding claim, characterised in that the fixing means (37A) are similar to, or identical with, said at least one locking member (37).

5. A suspended ceiling assembly according to claim 1, characterised in that said beams are channel shaped beams with their webs (11) uppermost and a pair of spaced depending flanges (12) each flange ending in a free edge, in that said locating means comprise apertures formed in said webs, in that the clips include a body (38) extending beside an outside surface of one flange (12) of the channel, an upper arm (39) extending over a portion of the web (11), with a projection (40) on the upper arm engaging in the aperture (41), and a lower arm (42) extending under said flange, the side of the arm being engageable by a supporting member to hold the supporting member in position.

6. A suspended ceiling assembly according to claim 5, characterised in that the free edges of the flanges (12) of the beams (8) have inwardly extending rims (13) along which portions of said supporting members slide, in that the lower arm (42) of each clip has an upturned tab (43) lockably engageable against the inner surface of the rim, to retain the clip in place and in that each clip includes a tongue (44) which can be manually grasped to disengage the tab from the rim, to enable the clip to be removed.

7. A suspended ceiling assembly according to claim 1 or 2, characterised in that the distance members are formed by rods, strips or the like, each distance member being carried by a supporting member and slidably and engageably cooperating with an adjacent supporting member, or an adjacent distance member, said distance members being interchangeable to give a different preselected spacing between adjacent panels.

8. A suspended ceiling assembly according to any one of claims 1 to 2, characterised in that the distance members comprise a cord or bead chain between adjacent supporting members or panels.

* * * * *